US011091859B2

(12) United States Patent
Fedner

(10) Patent No.: US 11,091,859 B2
(45) Date of Patent: Aug. 17, 2021

(54) STRETCH KNIT METAL CHAIN FABRICS

(71) Applicant: Natalia Fedner Design, Los Angeles, CA (US)

(72) Inventor: Natalia Fedner, West Hollywood, CA (US)

(73) Assignee: Natalia Fedner Design, Los Angeles, CA (US)

( * ) Notice: Subject to any disclaimer, the term of this patent is extended or adjusted under 35 U.S.C. 154(b) by 629 days.

(21) Appl. No.: 15/073,183

(22) Filed: Mar. 17, 2016

(65) Prior Publication Data

US 2016/0289871 A1 Oct. 6, 2016

Related U.S. Application Data

(60) Provisional application No. 62/136,323, filed on Mar. 20, 2015.

(51) Int. Cl.

| | |
|---|---|
| ***D04B 1/14*** | (2006.01) |
| ***D04B 1/24*** | (2006.01) |
| ***D04B 15/44*** | (2006.01) |
| ***D04B 15/90*** | (2006.01) |

(52) U.S. Cl.

CPC ..... *D04B 1/14* (2013.01); *D04B 1/24* (2013.01); *D04B 15/44* (2013.01); *D04B 15/90* (2013.01); *D10B 2101/20* (2013.01); *D10B 2501/00* (2013.01)

(58) Field of Classification Search

CPC . D04B 1/14; D04B 1/24; D04B 15/44; D04B 15/90; D10B 2101/20; D10B 2501/00

See application file for complete search history.

(56) References Cited

U.S. PATENT DOCUMENTS 2,218,559 A * 10/1940 Stephens ..... B21F 27/02 140/71 R
2,278,926 A * 4/1942 Hartwell ..... B65G 15/54 66/202

FOREIGN PATENT DOCUMENTS

GB 0425818 * 3/1935

OTHER PUBLICATIONS

Zimmerman, Wiliam, Make Chain Mail Armor from Start to Finish, Wonder How To Metalworking. https://metalsmithing.wonderhowto.com/how-to/make-chain-mail-armor-from-start-finish-0118499/ (Year: 2013).*

(Continued)

*Primary Examiner* — Cephia D Toomer
(74) *Attorney, Agent, or Firm* — KCO Legal, Inc.

(57) ABSTRACT

A knitted metal fabric of at least two rows of loops, the rows of loops comprising metal chain knitted together to form a knitted metal fabric. The metal chain comprises a plurality of links of metal linked together to form the chain. The knitted metal chain fabric may be made into garments or used in any manner as other fabrics. A method for making the fabric includes providing at least one metal chain of links flexibly linked together, feeding the metal chain into a knitting machine, maintaining an even tension on the chain, knitting the metal chain into a knitted pattern to form a fabric, and weighting the fabric.

13 Claims, 21 Drawing Sheets

(56) References Cited

OTHER PUBLICATIONS https://www.neimanmarcus.eom/p/ramy-brook-rosa-draped-chainmail-halter-top-prod215150206?ecid=NMDR_CRT&utm_medium=display%20remarketing&utm_source=NMDR_CRT#&gid=1 &pid=1 (Year: 2010).*
https://www.dollskill.com/festival-chainmail-bandana-necklace-gold.html Date unknown (Year: 2018).*
http:www.medievalwarfare.info/armour.htm (Year: 2010).*
https://www.youtube.com/watch?v=YQmmKq1WPHE Transcript for Knitting with Wire-Metal Arts, Aug. 6, 2010 (Year: 2010).*
Limabeans.com Website converted to pdf. (Year: 2002).*

* cited by examiner

STRETCH KNIT METAL CHAIN FABRICS

CROSS-REFERENCE TO RELATED APPLICATIONS

This application is a non-provisional patent application that claims the benefit of and the priority from U.S. Provisional Patent Application No. 62/136,323, filed Mar. 20, 2015, titled STRETCH KNIT METAL CHAIN FABRICS.

BACKGROUND

Technical Field

This invention relates to knitted fabrics, in particular to fabrics that are knitted using metal chains as the "yarns."

Background Information

Existing metal fabrics are either created using traditional weaves (versus knitting) or if employing a looping technique are made using single strands of metal such as wire. These fabrics lack flexibility and stretchability and do not exhibit 4 way stretch. Industrially, metal wire may be knitted into a metal fabric wide range of uses including the filter material for example in catalytic converters for cars and many other uses. These fabrics are usually manufactured on circular knitting machines that would be recognized by conventional knitters as sock machines. However, use of wire, i.e. a continuous filament does not provide the desire four way stretch required for wearability and flexibility.

BRIEF SUMMARY

Knitted fabrics of the present invention include fabrics made of metal. In particular, the fabrics of the present invention are made by using metal chains as the "yarns" of the fabrics and knitting them to form a metal fabric. The metal fabric may then be made into garments such as clothing or used for other purposes such as industrial purposes. The fabrics made according to the process here have true four way stretch. Suitable metals include any metal or alloys of metals than can be formed into a chain. The metals may include gold, silver, platinum, copper, brass, palladium, rhodium, titanium, tungsten, tungsten carbide, nickel and stainless steel, although other metals are within the scope of this disclosure. In some examples the metals may be electroplated.

The "yarns" of the knitted fabrics are chains of metals. The chains are formed from links of metal. The chains shapes may be oval, circular, square of other shapes. The links of the chains used as the "yarns" are sized such that when knitted into the fabric the fabric is extremely flexible and exhibits true four way stretch.

BRIEF DESCRIPTION OF THE DRAWINGS

FIG. 1A shows a cable chain.

FIG. 1B shows a crinkle chain.

FIG. 1C shows a FIG. 8 chain.

FIG. 1D shows a curb chain.

FIG. 1E shows a flat link cable chain.

FIG. 1F shows a hook chain.

FIG. 1G shows a marquis chain.

FIG. 1H shows a figaro chain.

DETAILED DESCRIPTION OF THE DRAWINGS AND THE PRESENTLY PREFERRED EMBODIMENTS

Figure 1A:
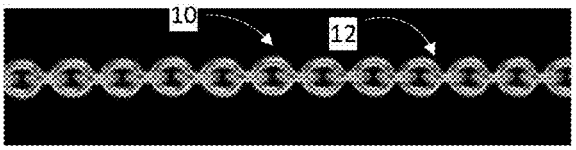
FIGS. 1A-1H show exemplary chain styles.

Knitted fabrics of the present invention include fabrics made of metal. In particular, the fabrics of the present invention are made by using metal chains as the "yarns" of the fabrics and knitting them to form a metal fabric. The metal fabric may then be made into garments such as clothing or used for other purposes such as industrial purposes. The fabrics made according to the process here have true four way stretch. Suitable metals include any metal or alloys of metals than can be formed into a chain. The metals may include, but are not limited to, gold, silver, platinum, copper, brass, palladium, rhodium, titanium, tungsten, tungsten carbide, nickel and stainless steel. In some examples the metals may be electroplated. As disclosed here, the metal fabrics use only metal links in a chain to create the stretchy, durable, and strong material. However, the metal fabric may be combined with other fabrics or materials to create a garment. Preferably, the metal fabric comprises at least two knitted rows of metal chain. However, the fabric may comprise a single row of knit metal with a subsequent non-metal row. Preferably, the metal fabric comprises at least two knitted rows of metal chain. In one embodiment, the metal fabric is made from a rigid material, such as plastic, coated in metal or metallic paint.

The "yarns" of the knitted fabrics are chains of metals. The chains are formed from links of metal that are linked together. The chain links may be oval, circular, square of other shapes. Preferably, the holes in the links are oval or circular, or other shapes may be used. The links of the chains used as the "yarns" are sized such that when knitted into the fabric the fabric is very flexible and exhibits true four way stretch. Link sizes of the metal chain yarns for making fabrics on conventional knitting machines include links that are up to 11 mm in length and width. The length and width may be the same or it may be different. For example, chains in which the links are longer than they are wide, such as FIG. 8 chains, may also be used. For example, FIG. 8 chains having a length ranging from 1.0 mm to 4 mm and a width from 0.5 mm to 2.0 mm also are suitable. The shapes of the links also may be different as shown in the figures.

Preferably, the links may have a length ranging from 0.25 mm to 4 mm and a width ranging from 0.25 mm to 3 mm. For metal knitted fabrics used for clothing, the length of the link preferably ranges from 0.25 mm to 4.0 mm. However, in industrial applications, the link length and width may be greater or smaller (for example for fencing or the like).

The hole size of the links may also vary. The holes may be of any suitable shape and are preferably circular or oval. Suitable hole sizes of the links of the chains that are knitted together on conventional knitting machines include link holes ranging from about 0.25×0.25 mm, 0.25×0.25 mm to about 4.0×4.0 mm. Suitable hole sizes include 0.5×0.5 mm, 0.5×1.0 mm links, 1.0×1.0 mm, 1.5×2.0 mm, 2.0×2.0 mm, 2.0×2.5 mm, 2.4×2.8, 2.5×3.0 s, 3.0×3.0, 3.0×3.5, 3.0×4.0, 3.5×3.5 mm, 3.5×4.0 mm, 4.0×4.0 mm and ranges. Although these are preferable sizes for garments, other applications such as industrial applications may include larger links with larger holes for non-garment applications or smaller links with smaller holes if the machine and its needles are modified to suit the purpose. For garment applications, such as blouses, shirts, dresses, skirts and the like a preferred hole size is 3 mm or less.

Figure 8:
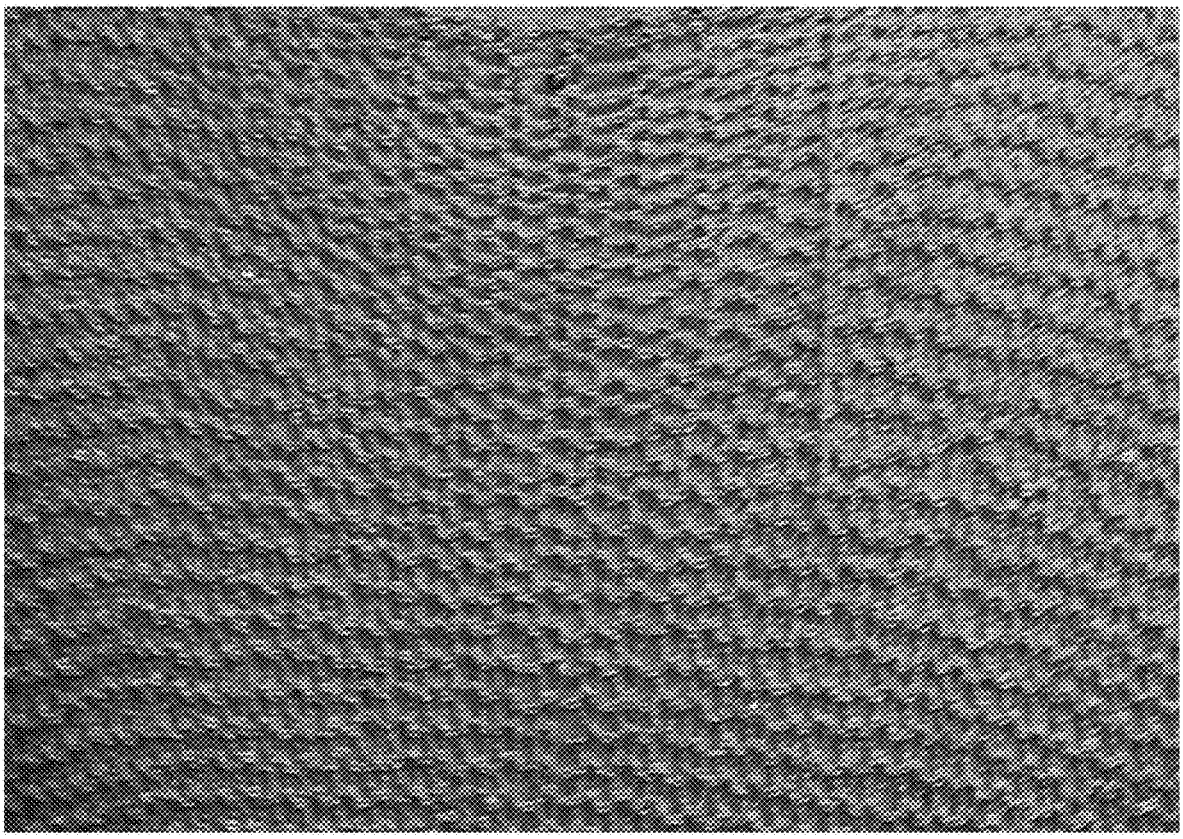
FIG. 8 shows a knitted metal chain fabric using a purl stitch.

Suitable chain types include cable chains, FIG. 8 chains, curb chains, flat link chains, hook chains, marquis chains, figaro chains, rolo chains, and round link chains. Other chains that may be used include, but the disclosure is not so limited, rope chains, twisted link chains, single jack chains, double jack chains, foxtail chains, anchor link chains, cable link chains, box chains and the like.

Figure 1B:
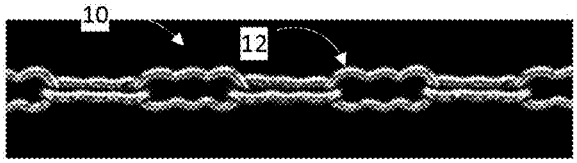
Figure 1C:
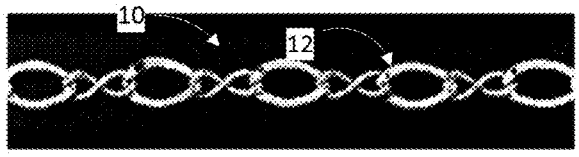
Figure 1D:
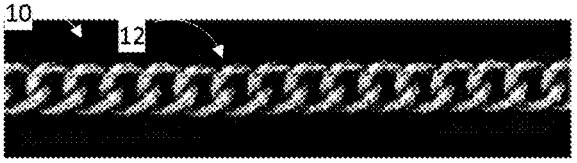
Figure 1E:
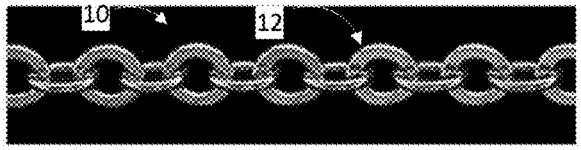
Figure 1F:
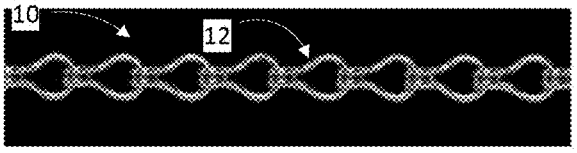
Figure 1G:
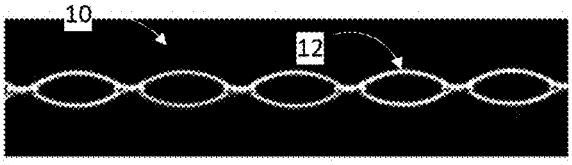
Figure 1H:
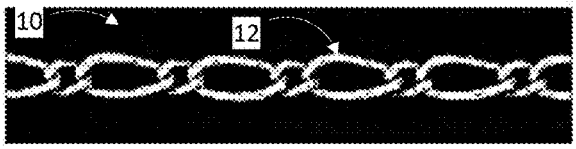
Figure 1I:
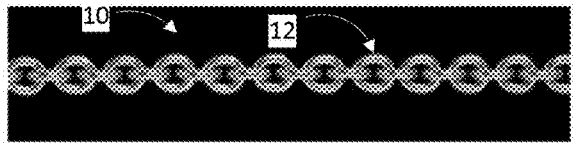
FIG. 1I shows a link chain.
Figure 1J:
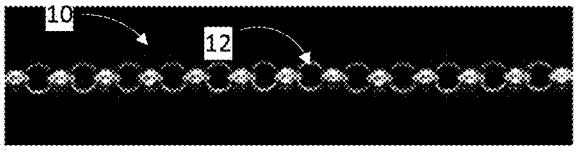
FIG. 1J shows a rolo chain.
Figure 1K:
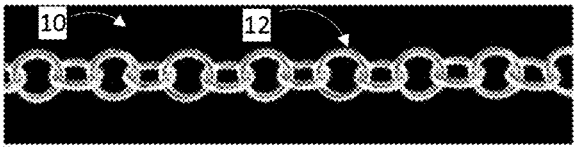
FIG. 1K shows a round link chain.

FIGS. 1A-1G show exemplary chains that may be used as "yarns" of the present invention. For example, FIG. 1A shows a cable chain. FIG. 1B shows a crinkle chain. FIG. 1C shows a FIG. 8 chain. FIG. 1D shows a curb chain. FIG. 1E shows a flat link cable chain. FIG. 1F shows a hook chain. FIG. 1G shows a marquis chain. FIG. 1H shows a figaro chain. FIG. 1I shows a link chain. FIG. 1J shows a rolo chain and FIG. 1K shows a round link chain. As shown, each chain 10 contains a series of interconnected links 12.

Chains used for the fabrics need not include a single type of chain or chains having the same link size and it is contemplated that the different types of chains and chain of differing link sizes may be used as the "yarns." Preferably, the links in the chains are of the same size or close to the same size.

Fabrics made by the method of the current invention are very stretchable and very flexible. The fabrics have true 4-way stretch. 2-way stretch fabrics stretch in one direction, usually from selvedge to selvedge (but can be in other directions depending on the knit). 4-way stretch stretches in both directions, crosswise and lengthwise.

The topology of a knitted fabric is relatively complex. Unlike woven fabrics, where strands usually run straight horizontally and vertically, yarn that has been knitted follows a looped path along its row, as with the darker strand in FIG. 2, in which the loops of one row have all been pulled through the loops of the row below it. Because there is no single straight line of yarn anywhere in the pattern, a knitted piece of fabric can stretch in all directions. This is called true 4-way stretch. This elasticity is all but unavailable in traditional, non elastane, woven fabrics, which only stretch along the bias.

The basic knitted fabric (as in FIG. 2, and usually called a stocking or stockinette pattern) has a definite "right side" and "wrong side". On the right side, the visible portions of the loops are the verticals connecting two rows which are arranged in a grid of V shapes. On the wrong side, the ends of the loops are visible, both the tops and bottoms, creating a much more bumpy texture sometimes called reverse stockinette. (Despite being the "wrong side," reverse stockinette is frequently used as a pattern in its own right.) Because the yarn holding rows together is all on the front, and the yarn holding side-by-side stitches together is all on the back, stockinette fabric has a strong tendency to curl toward the front on the top and bottom, and toward the back on the left and right side.

Stitches can be worked from either side, and various patterns are created by mixing regular knit stitches with the "wrong side" stitches, known as purl stitches, either in columns (ribbing), rows (garter, welting), or more complex patterns. Each fabric has different properties: a garter stitch has much more vertical stretch, while ribbing stretches much more horizontally. Because of their front-back symmetry, these two fabrics have little curl, making them popular as edging, even when their stretch properties are not desired.

Different combinations of knit and purl stitches, along with more advanced techniques, generate fabrics of considerably variable consistency, from gauzy to very dense, from highly stretchy to relatively stiff, from flat to tightly curled, and so on.

Figure 2:
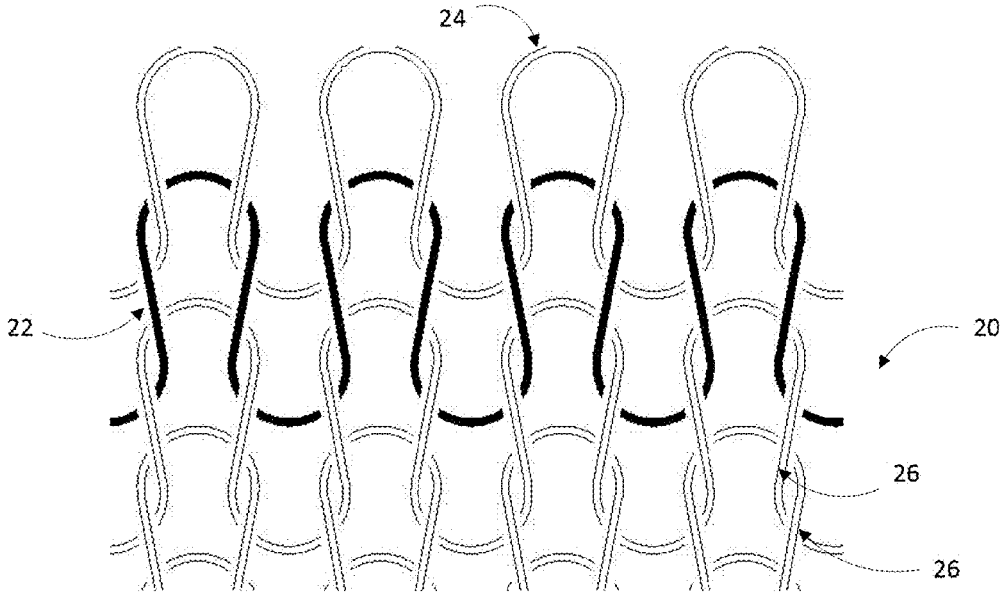
FIG. 2 shows a stockinette style of knitting.

The most common knitted type of fabric or fabric includes stockinette stitches. The structure of stockinette 20 is shown in FIG. 2. Here, the meandering dark path defines one course 22—the path of the yarn through the fabric. The upper links 24 are unsecured and are "active," but they secure links 22. In turn, links 22 secure links 26, which in turn secure links below them and so on. To secure a stitch, at least one new link is passed through it. Although the new stitch is itself unsecured ("active" or "live"), it secures the stitch(es) suspended from it. A sequence of stitches in which each stitch is suspended from the next is called a wale. To secure the initial stitches of a knitted fabric, a method for casting on is used; to secure the final stitches in a wale, one uses a method of binding/casting off.

In securing the previous stitch in a wale, the next stitch can pass through the previous link from either below or above. If the former, the stitch is denoted as a knit stitch or a plain stitch; if the latter, as a purl stitch. The two stitches are related in that a knit stitch seen from one side of the fabric appears as a purl stitch on the other side. The two types of stitches have a different visual effect; the knit stitches look like "V"'s stacked vertically, whereas the purl stitches look like a wavy horizontal line across the fabric. Patterns and pictures can be created by knitting two or more different colored materials together using fairisle and other image knitting techniques. Individual stitches, or rows of stitches, may be made taller by drawing more yarn into the new loop (an elongated stitch), which is the basis for uneven knitting: a row of tall stitches may alternate with one or more rows of short stitches for an interesting visual effect. As an illustrative example, short and tall stitches may also alternate within a row, forming a fish-like oval pattern.

Figure 3:
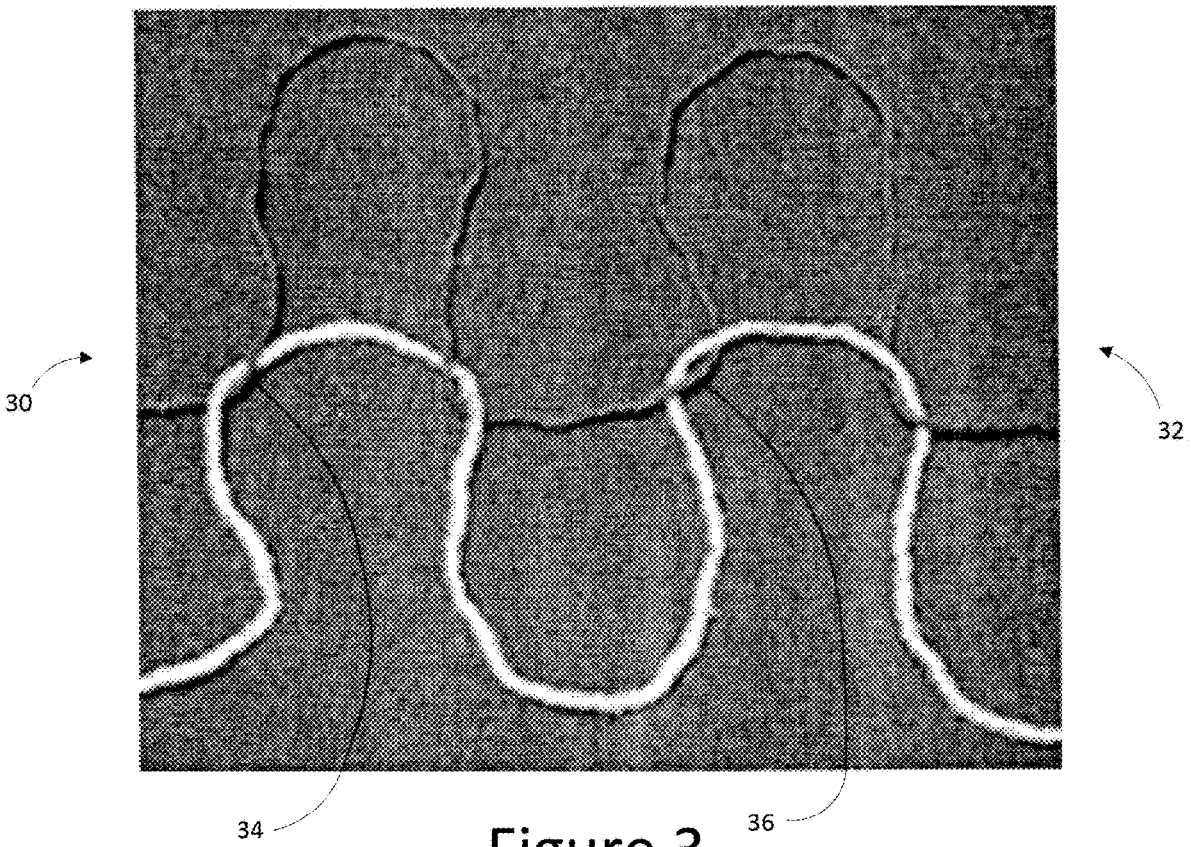
FIG. 3 shows knit and purl stitches.

FIG. 3 shows a knit stitch 30 and a purl stitch 32. As shown, the knit stitch 30 passes through the loop 34 from below. In the purl stitch 32, the next stitch 36 enters from above. Thus, a knit stitch on one side of the fabric appears as a purl stitch on the other and vice versa.

There are many hundreds of stitches used by knitters. In the simplest knitted fabrics, all the stitches are knit or purl; this is known as a garter stitch. Alternating rows of knit stitches and purl stitches produce what is known as a stockinette pattern/stocking stitch. Vertical stripes (ribbing) are possible by having alternating wales of knit and purl stitches. For example, a common choice is 2×2 ribbing, in which two wales of knit stitches are followed by two wales of purl stitches, etc. Horizontal striping (welting) is also possible, by alternating rows of knit and purl stitches. Checkerboard patterns (basketweave) are also possible, the smallest of which is known as seed/moss stitch: the stitches alternate between knit and purl in every wale and along every row.

Not every stitch in a row need be knitted; some may be left "as is" and knitted on a subsequent row. This is known as slip-stitch knitting. The slipped stitches are naturally longer than the knitted ones. For example, a stitch slipped for one row before knitting would be roughly twice as tall as its knitted counterparts. This can produce interesting visual effects, although the resulting fabric is more rigid because the slipped stitch "pulls" on its neighbours and is less deformable.

Mosaic knitting is a form of slip-stitch knitting that knits alternate colored rows and uses slip stitches to form patterns; mosaic-knit fabrics tend to be stiffer than patterned fabrics produced by other methods such as Fair-Isle knitting. In some cases, a stitch may be deliberately left unsecured by a new stitch and its wale allowed to disassemble. This is known as drop-stitch knitting, and produces a vertical ladder of see-through holes in the fabric, corresponding to where the wale had been.

The initial and final edges of a knitted fabric are known as the cast-on and bound/cast-off edges. The side edges are known as the selvages; the word derives from "self-edges," meaning that the stitches do not need to be secured by anything else. Many types of selvages have been developed, with different elastic and ornamental properties.

Vertical and horizontal edges can be introduced within a knitted fabric, e.g., for button holes, by binding/casting off and re-casting on again (horizontal) or by knitting the fabrics on either side of a vertical edge separately as known in the art. Two knitted fabrics can be joined by embroidery-based grafting methods, most commonly the Kitchener stitch. New wales can be begun from any of the edges of a knitted fabric; this is known as picking up stitches and is the basis for entrelac, in which the wales run perpendicular to one another in a checkerboard pattern.

The most basic form of knitting is flat knitting. Flat knitting, in its most basic form, is used to make flat pieces of cloth. It is done with two straight knitting needles and is worked in rows, horizontal lines of stitches. Flat knitting is usually used to knit flat pieces like scarves, blankets, afghans, and the backs and fronts of dresses, shirts, sweaters and pullovers. Circular knitting (also called "knitting in the round") is a form of knitting that can be used to create a seamless tube. Knitting is worked in rounds (the equivalent of rows in flat knitting). Circular knitting is used in creating pieces that are circular or tube-shaped, such as hats, socks, mittens, and sleeves.

Figure 4:
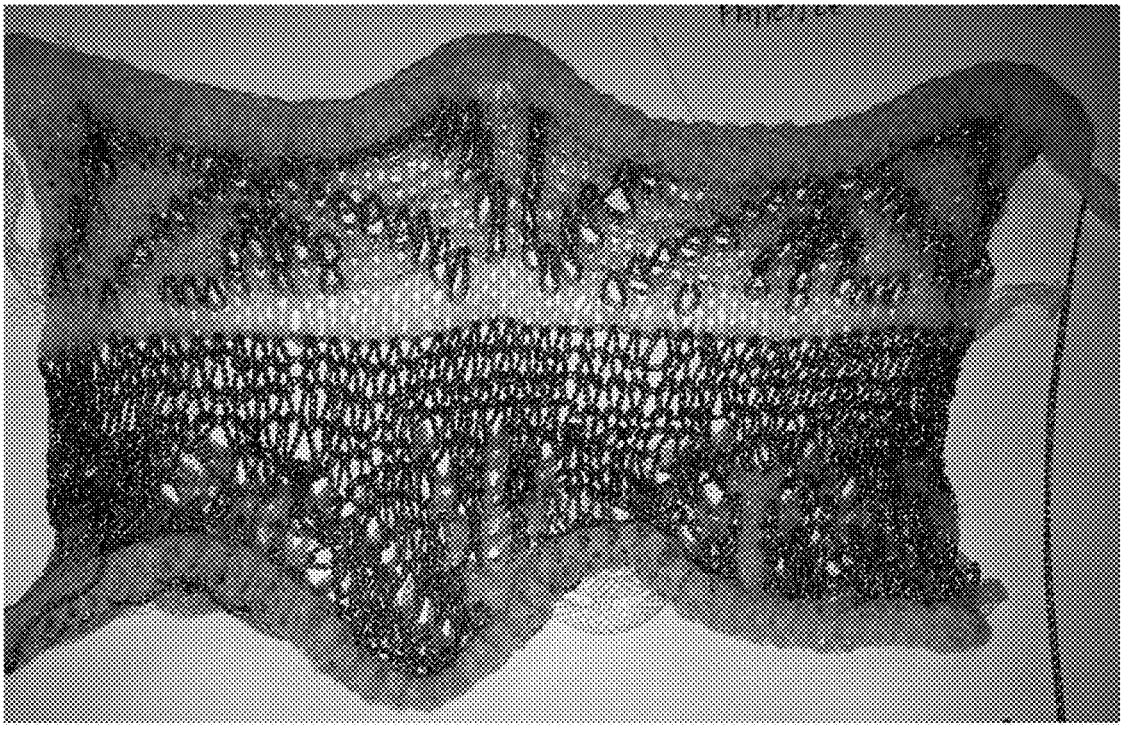
FIG. 4 shows a knitted metal chain and yarn fabric using a Fair Isle stitch.
Figure 5:
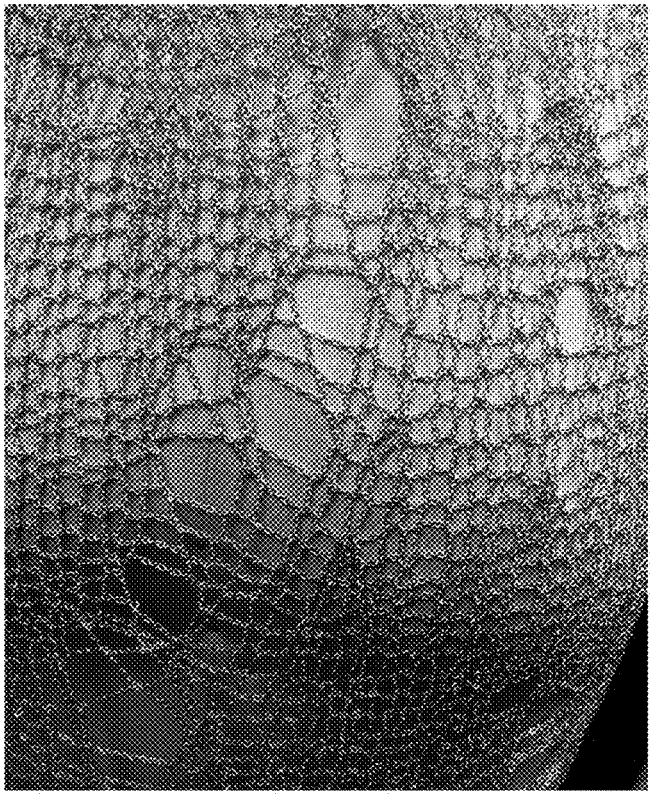
FIG. 5 shows a knitted metal chain garment using a dropped stitch.
Figure 6:
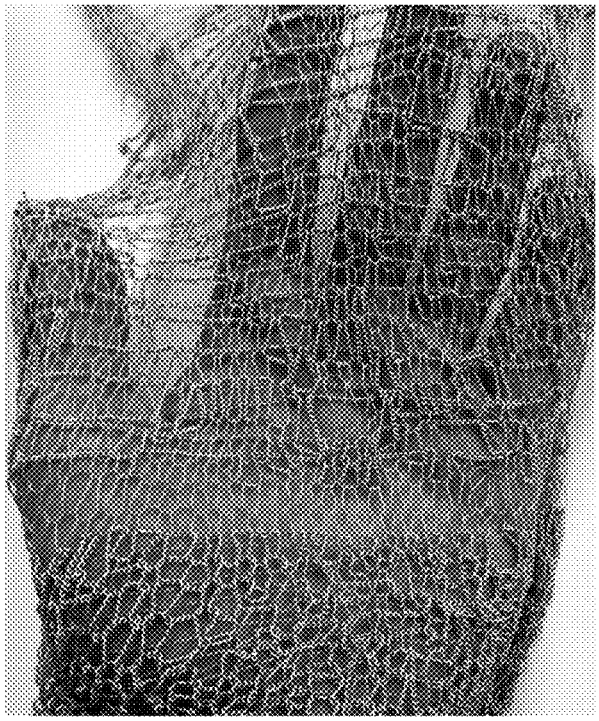
FIG. 6 shows a knitted metal chain fabric using a thread lace stitch.
Figure 7:
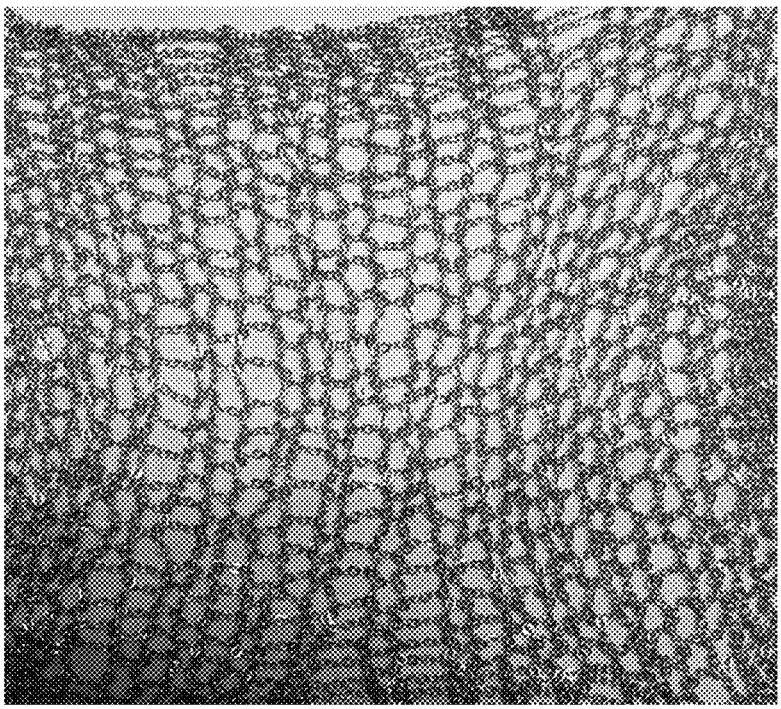
FIG. 7 shows a knitted metal chain fabric using a stockinette stitch.
Figure 9:
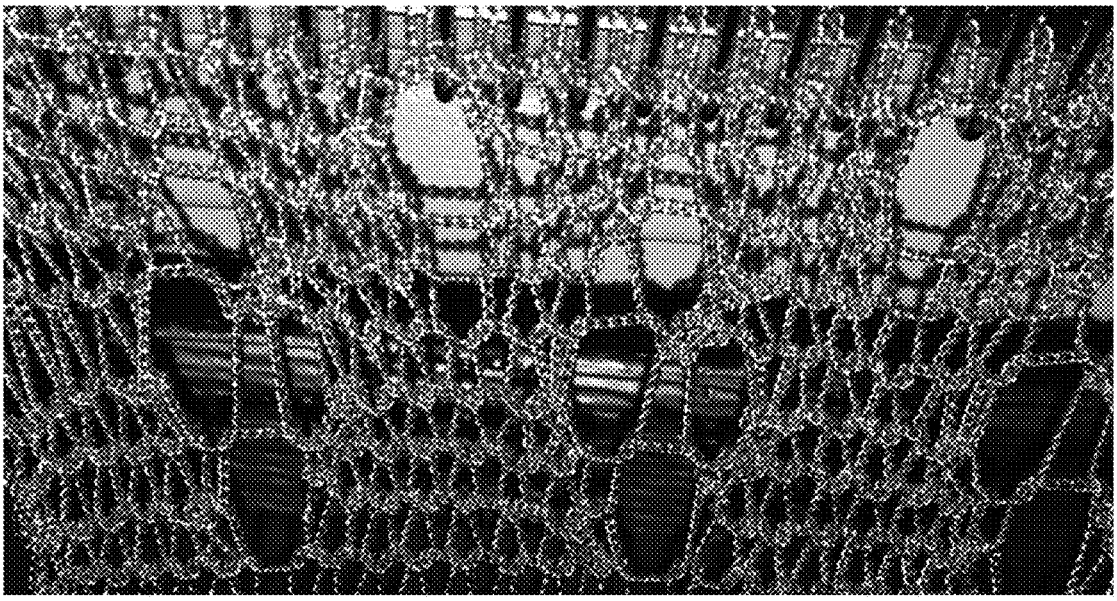
FIG. 9 a knitted metal chain fabric using a lace stitch.
Figure 10:
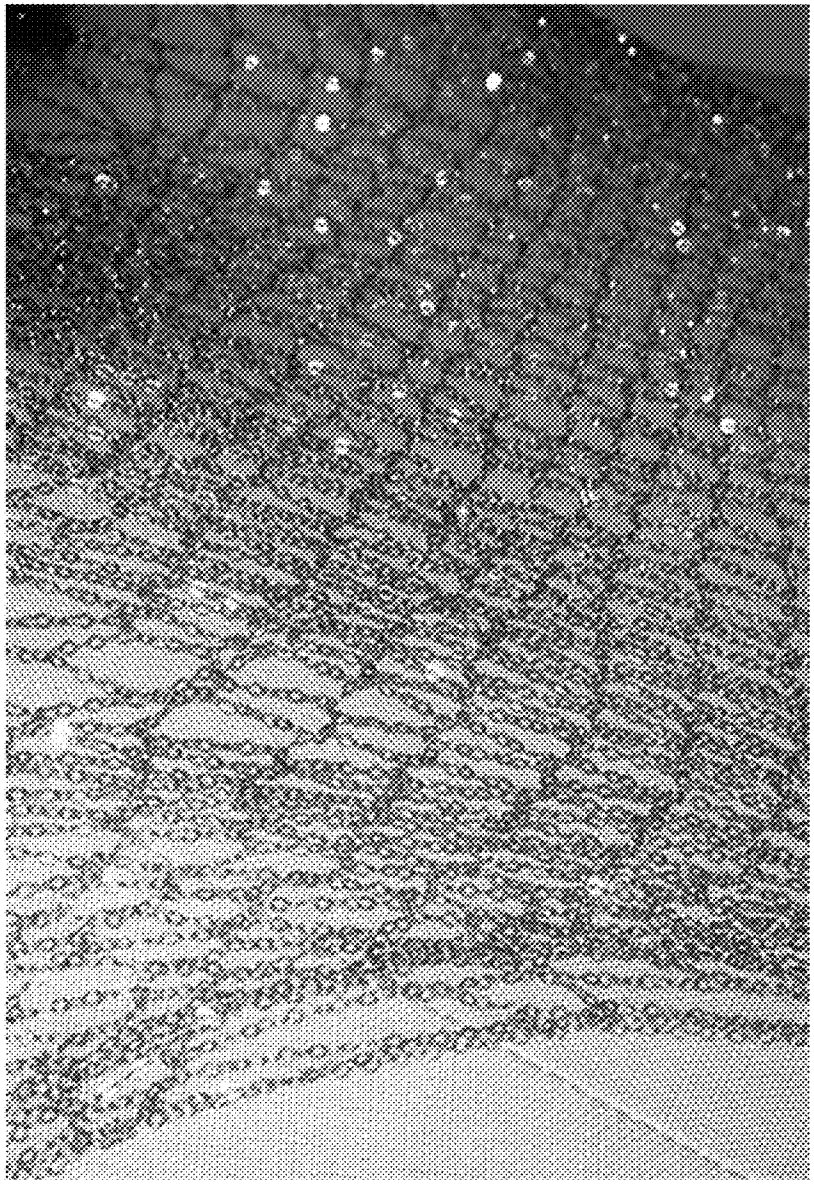
FIG. 10 shows a close up of a knitted metal chain fabric.
Figure 11:
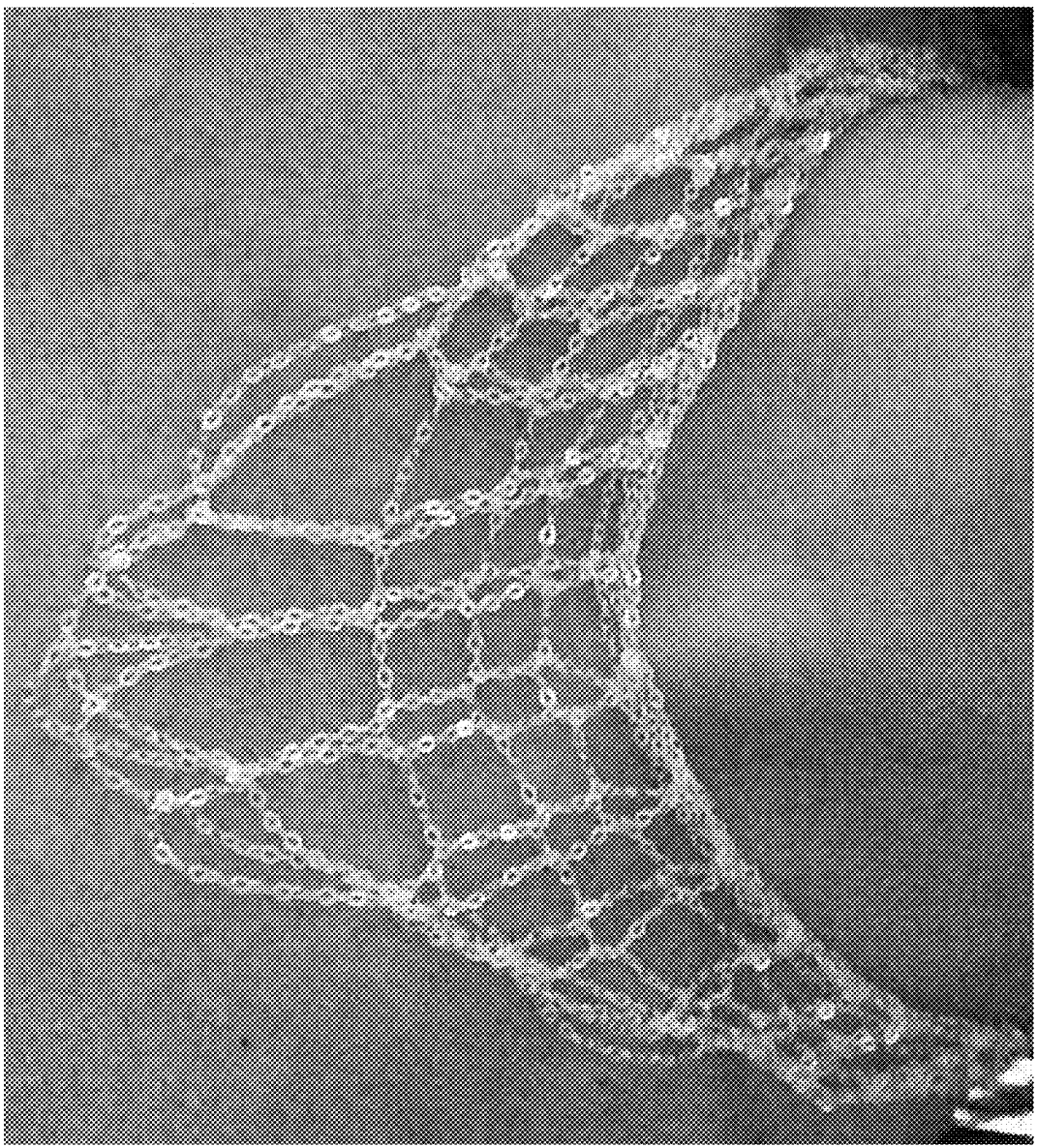
FIG. 11 shows another close up of a knitted metal chain fabric.
Figure 12A:
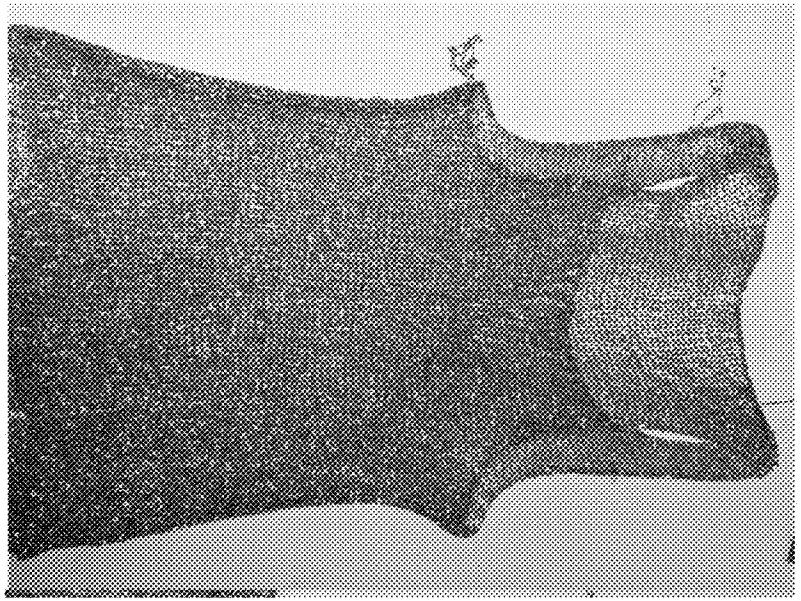
FIGS. 12A-F show the same garment made of knitted metal chain and the flexibility and stretchability of the that garment.
Figure 12B:
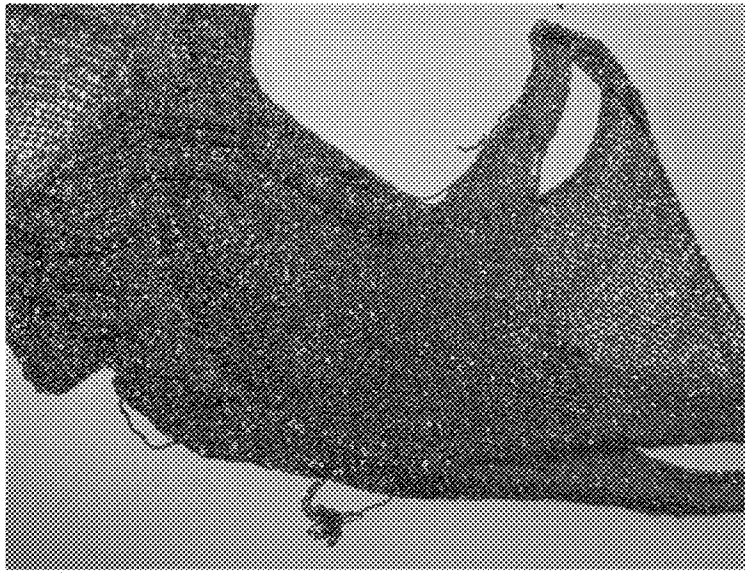
Figure 12C:
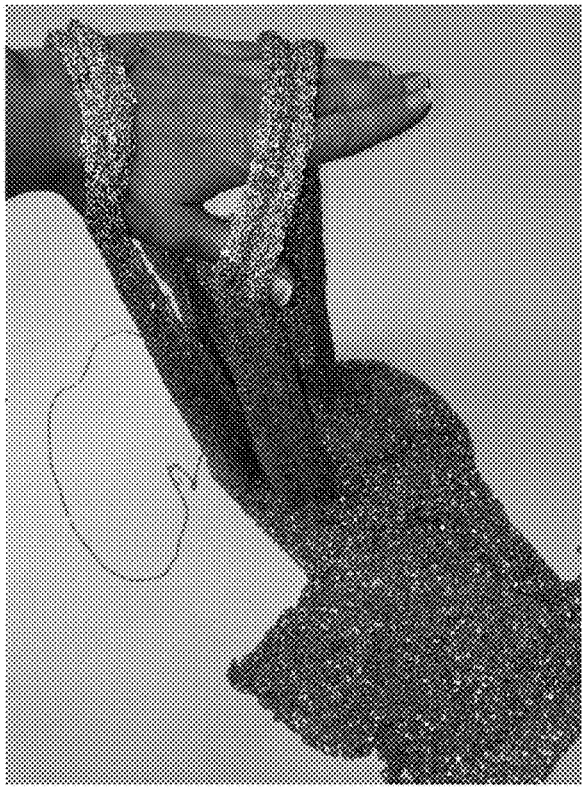
Figure 12D:
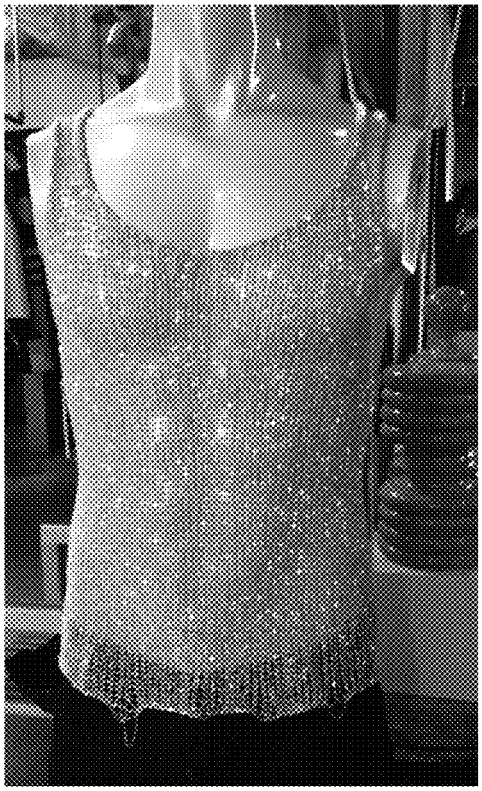
Figure 12E:
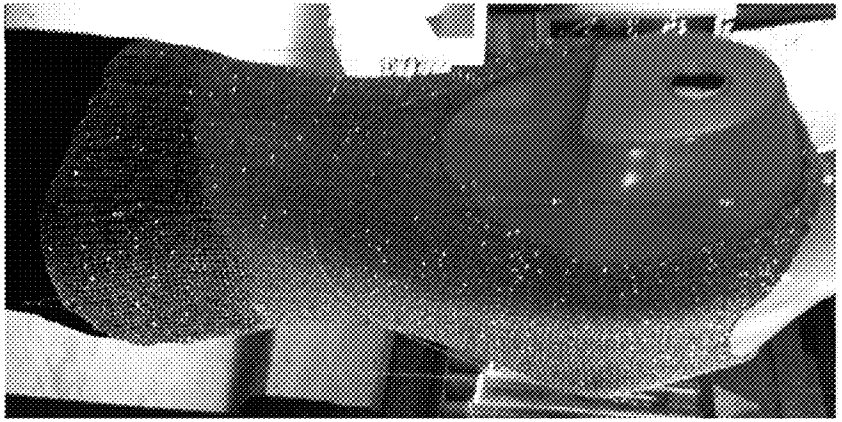
Figure 12F:
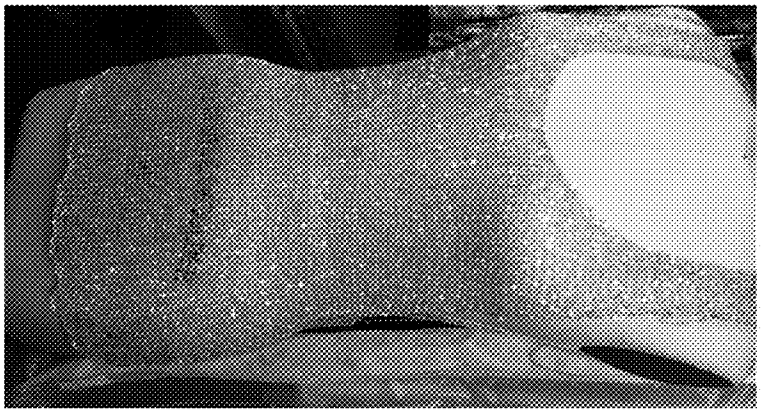
Figure 13A:
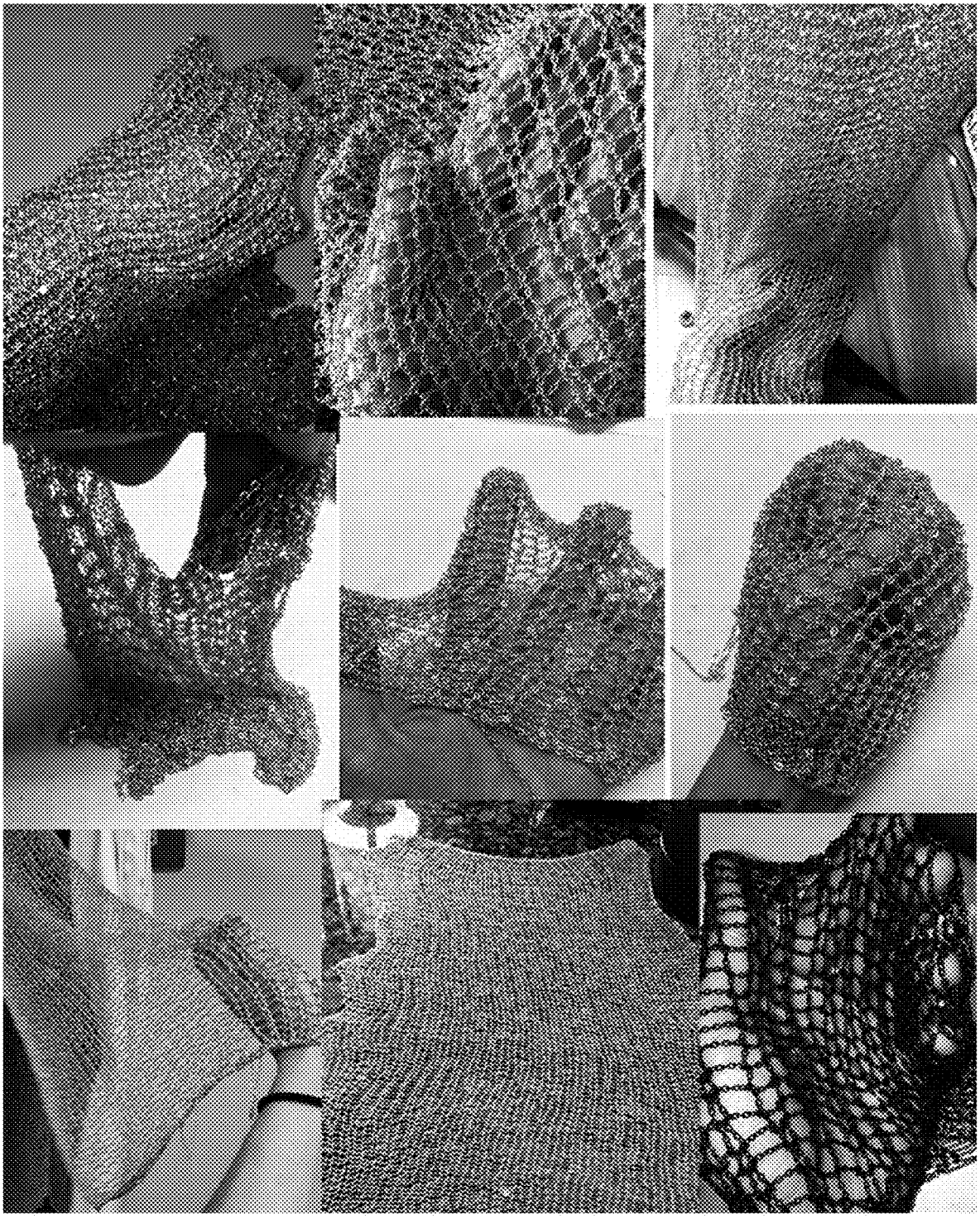
FIG. 13A shows the flexibility of fabrics of the invention made of knitted metal chain.
Figure 13B:
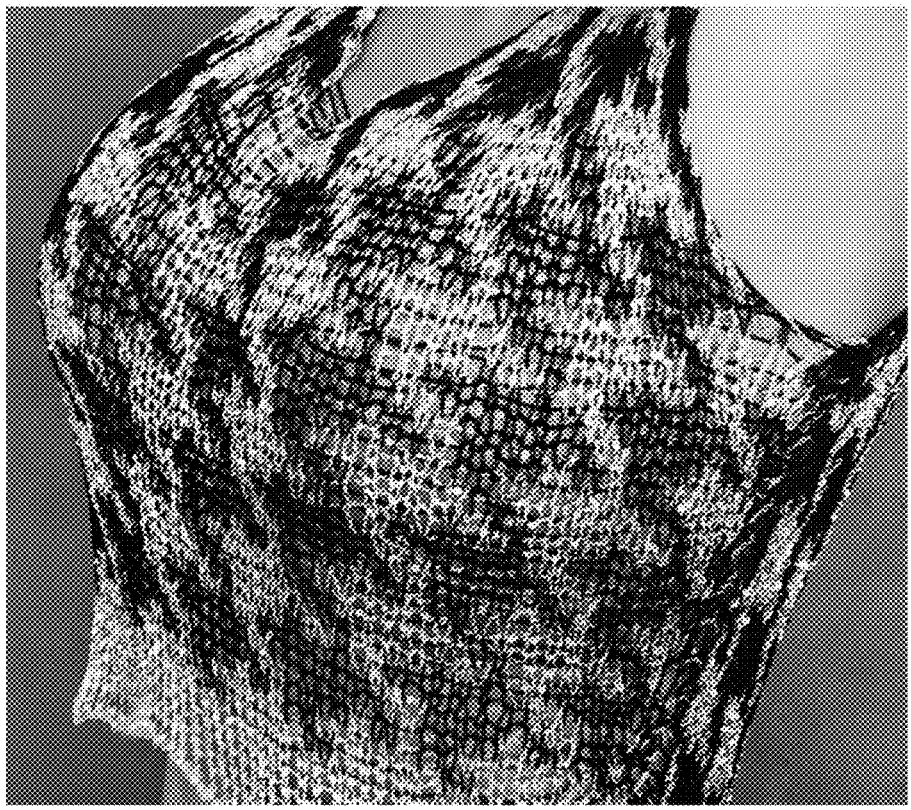
FIGS. 13B and 13C shows pattern knitting.
Figure 13C:
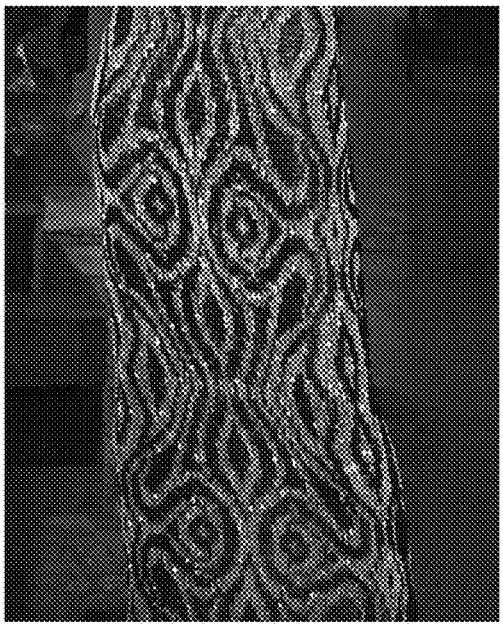

FIGS. 4-11 show various fabrics and garments made by knitting metal chains to form the fabrics using various stitches. FIG. 4 shows a knitted metal chain and yarn fabric using a Fair Isle stitch. FIG. 5 shows a knitted metal chain garment using a dropped stitch. FIG. 6 shows a knitted metal chain fabric using a thread lace stitch. FIG. 7 shows a knitted metal chain fabric using a stockinette stitch. FIG. 8 shows a knitted metal chain fabric using a purl stitch. FIG. 9 a knitted metal chain fabric using a lace stitch. FIG. 10 shows a close up of a knitted metal chain fabric. FIG. 11 shows another close up of a knitted metal chain fabric. FIGS. 12A-F and 13A show the flexibility and stretchability of knitted metal chain fabrics of the invention. FIGS. 12A-F are all images of the same garment. FIG. 12D shows the garment on a male form. FIG. 12F shows the same garment on a female form. FIGS. 12D and 12F serve to highlight how the fabric will take on the shape of its wearer due to its flexibility and stretchability. FIGS. 13B and 13C shows pattern knitting where two different colored chains are knit together to form an image or pattern using a fairisle technique that is conventional to standard machine knitting.

Figure 14A:
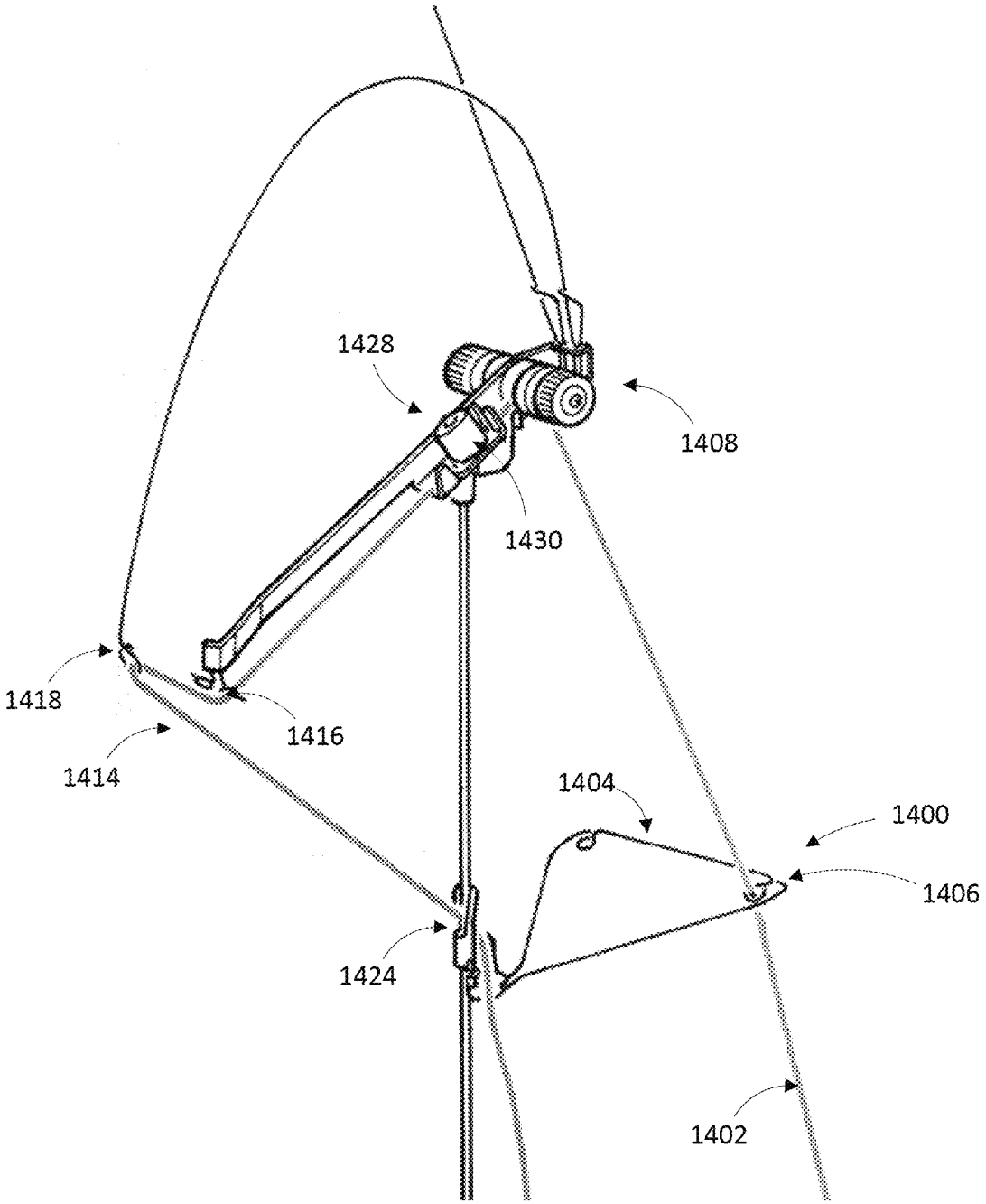
FIGS. 14A and 14B show a conventional knitting and machinery for nonmetal yarns.
Figure 14B:
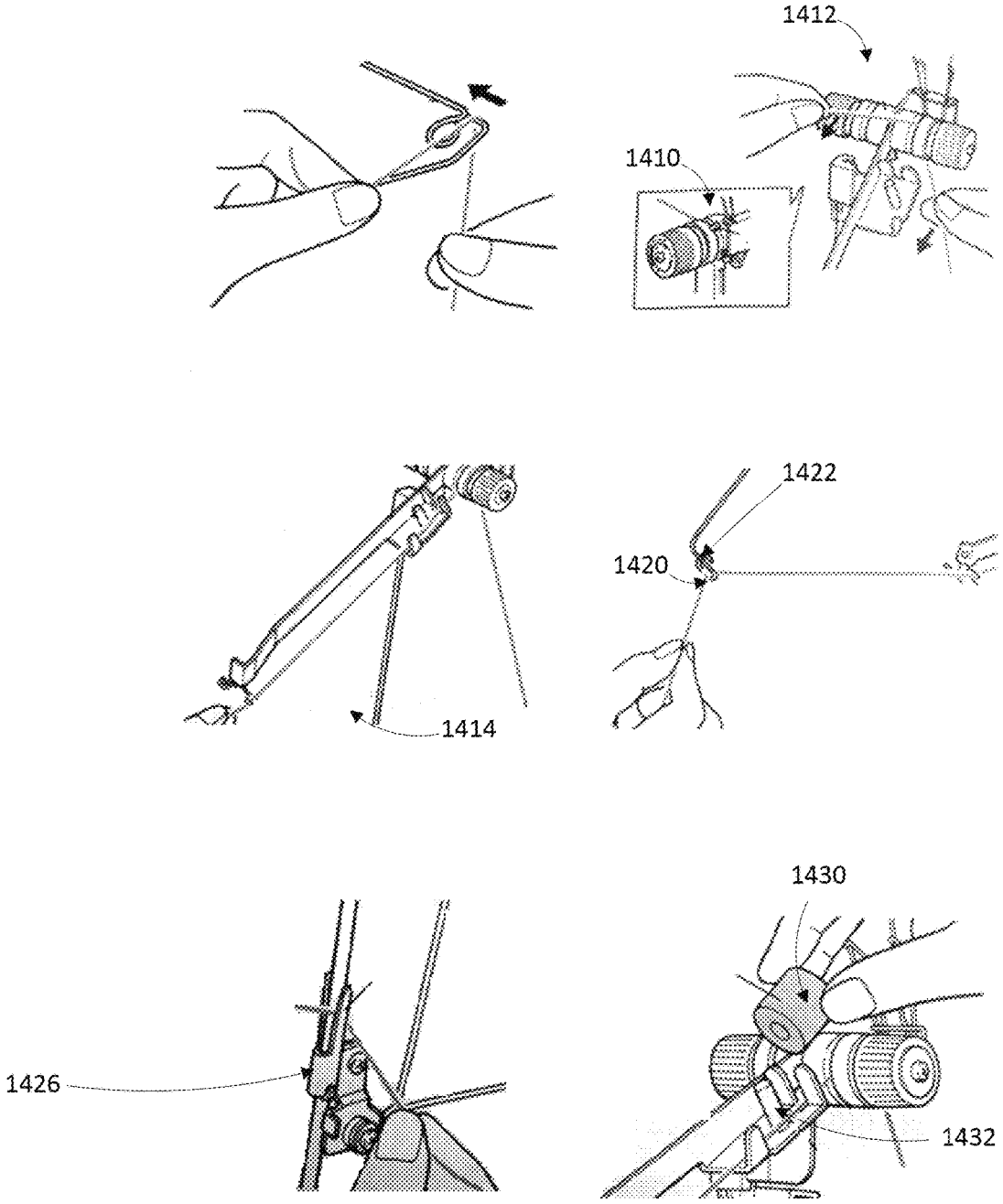

Referring to FIGS. 14A and B, a conventional machine knitting process is shown. In step 1, 1400, yarn 1402 is passed from a ball of yarn (not shown) through the rear yarn guide 1404 sliding the yarn through the eyelet 1406. Then the yarn, in step 2 1408 is passed under the pin 1410 and between two discs 1412 from behind. The yarn is held has shown in step 2 and it is pulled towards the operator so the yarn goes under the pin 1410. Then, in step 3 1414 the yarn is threaded through the front yard guide 1416 and in step 4 1418 the yarn is threaded through the eyelet 1420 of the take up spring 1422. In step 5 1424, the yarn is clipped under the yard clip 1426 and then step 6 1428, when knitting has started, wax 1430 is set on the wax stand 1432.

Figure 15A:
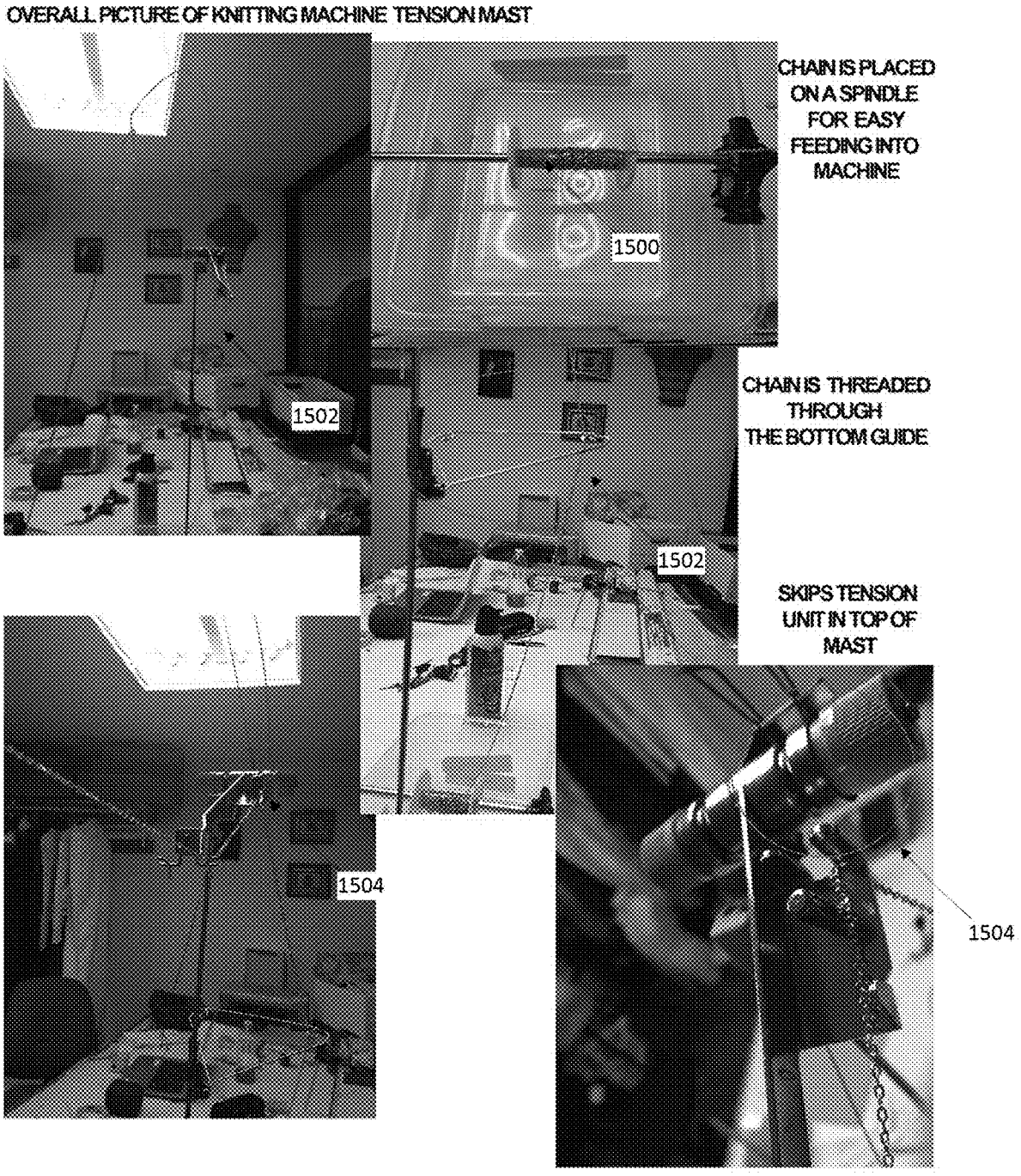
FIGS. 15A and 15B show a knitting apparatus and method used to make the knitted metal chain fabrics of the invention.
Figure 15B:
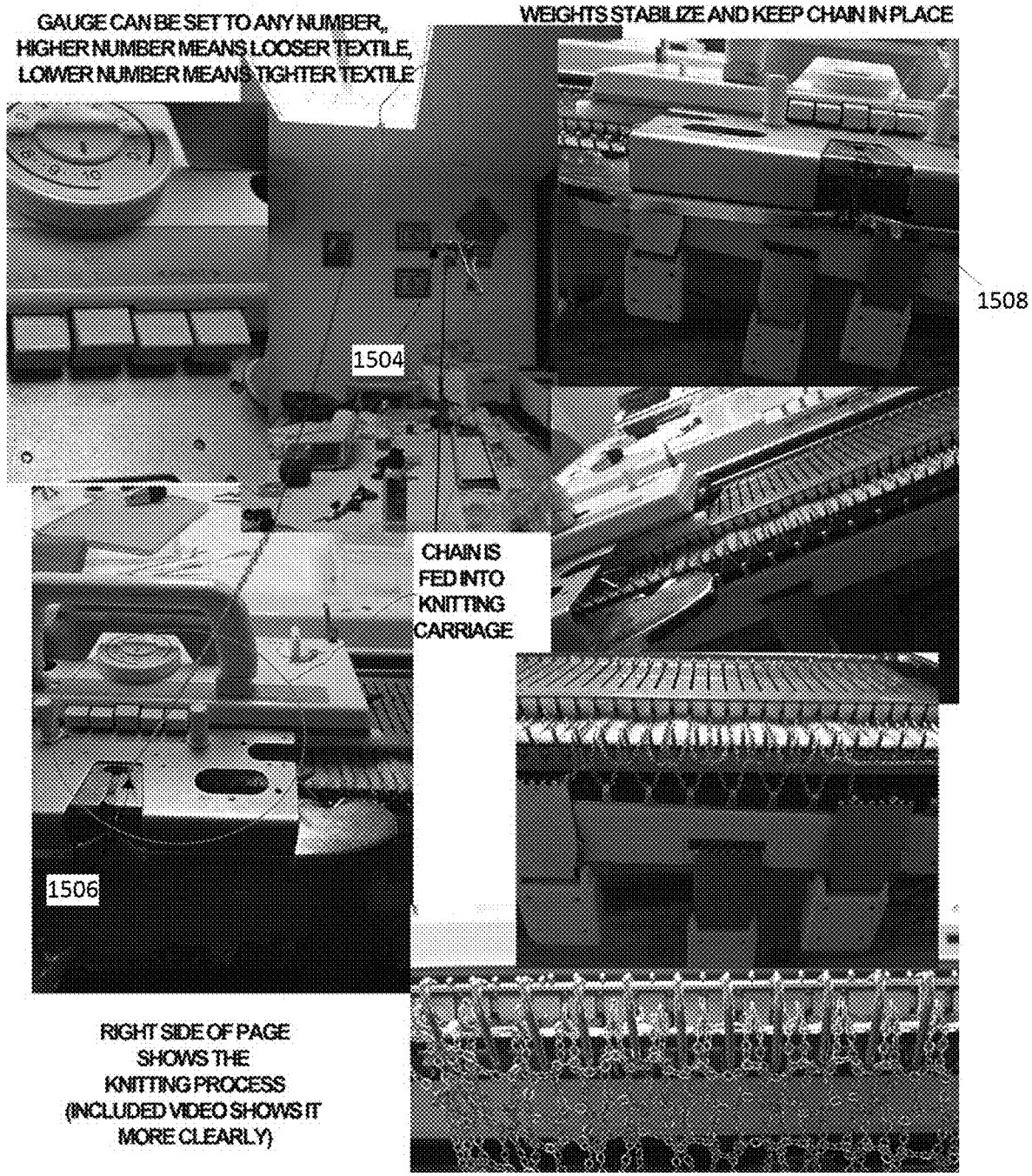

An exemplary process for making the metal chain fabrics of the present invention is described in the example below referring to FIGS. 15A and B. Using a knitting machine, such as the bulky 9 mm gauge Brother KH260 model a metal chain is placed on a spool 1500 which is suspended in the air using a metal spoke over a bin. The chain is fed into the machine 1502 in a standard manner as described by most knitting machine manuals except for metal machines. In metal machines such as the Brother KH260 process skips the top tension unit 1504. For plastic/hobby machines such as the Singer LK100, the process uses the top tension unit.

When machine knitting, the chain has to have a certain strength in order to not break during this process—this strength can be determined by whether the chain can be ripped by hand fairly easily. After the chain is fed into the machine 1502, it is "cast on" using any traditional knitting technique as discussed above. The machine carriage 1506 is then pushed back and forth to knit the metal chain. Once it is complete, the garment or swatch is taken off the machine, bound off by hand. The garments may be sewn together by hand, but can also be connected using linking machinery. The metal chain fabric can also be made on the smaller gauge machines such as the 4.5 mm gauge Brother KH930 but the chain holes must be smaller and thinner as the needles of the machine are smaller.

Figure 16:
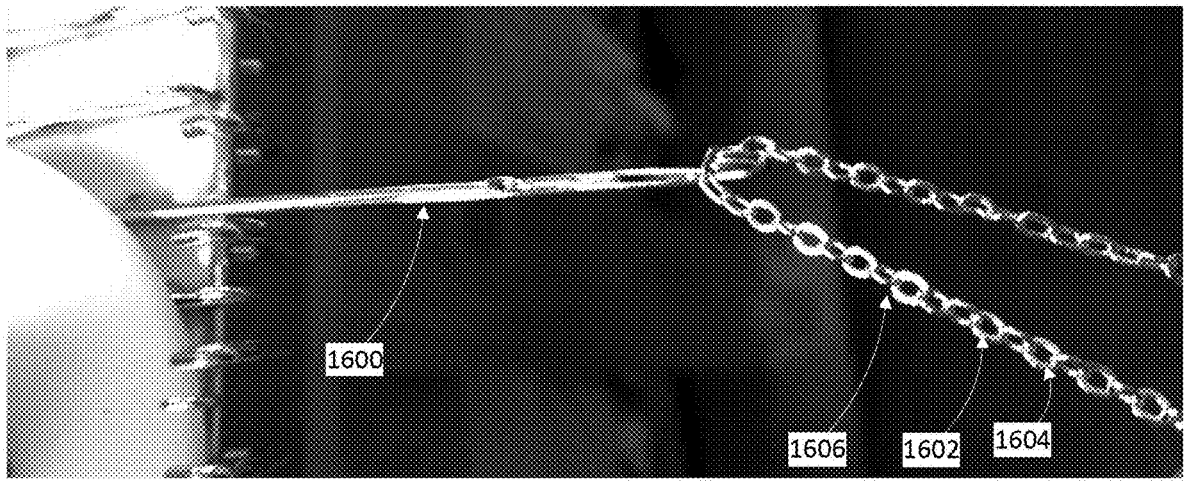
FIG. 16 shows a knitting needle engaging a metal chain for knitting.

As set forth above, the metal chain should be strong enough to withstand the machinery without breaking and the hole size of the chain must be sized for the needle of the machine. For example, with the larger machines, the hole size can be from 0.25 mm to 2 mm and in the smaller machines the hole size can be from 0.25 mm to 1.3 mm. For example, a chain having a hole size of 1.5 mm will use a standard needle meant for 9 mm machines (such as the Brother KH260, Singer SK150, Singer LK100, Toyota 600). For example, a chain having a hole size of 0.5 mm will use a standard needle meant for 4.5 mm machines (such as the Brother KH840, Brother KH930, Singer SK360, Toyota 858). See FIG. 16 showing an appropriate needle 1600 for the hole 1602 of the links 1604 of the chain 1606 shown (this is on the Brother KH270—a 9 mm knitting machine). The tip of the needle preferably is not smaller than the holes in the links as the needle may become stuck in the hole. Hence, the size of the tip of the needle should be equal in size to or larger in size than the holes in the links.

An exemplary method for machine knitting the fabric of the present invention includes the steps of providing at least one metal chain of links flexibly linked together, the links having holes, selecting a needle size configured to be equal or greater to the size of the holes, feeding the metal chain into a knitting machine, maintaining an even tension on the chain, weighting the chain, and knitting the metal chain into a knitted pattern to form a fabric.

Figure 17:
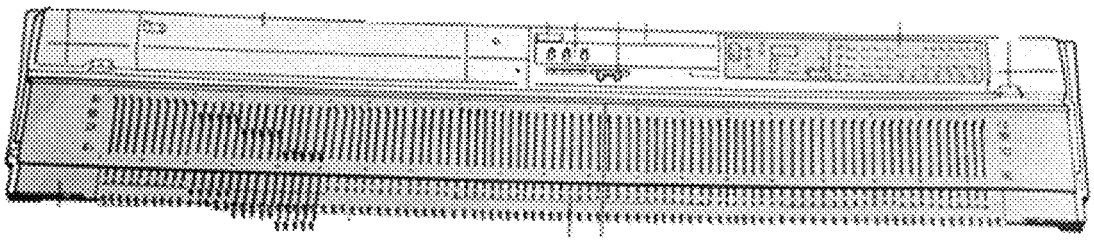
FIG. 17 shows diagrams of conventional knitting machine and parts.
Figure 17:
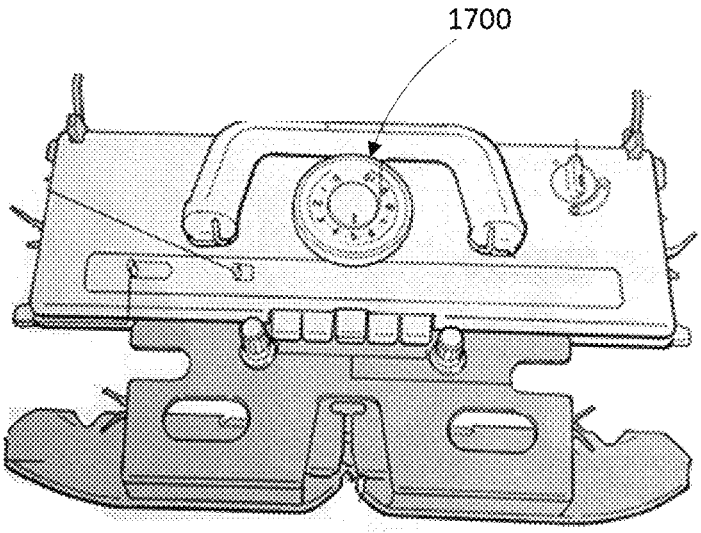

FIG. 17 shows diagrams of conventional knitting machine and parts. The carriage handle 1700 controls how tight the stitches of the knitted metal chain fabric. Hence, the fabric can be knitted with a tight knit or looser knits as shown in the Figures. For example, in a garment such as a dress or women's shirt, it may be desirable to provide a very tight knit such that the spaces or interstices in the fabric are very small. In one embodiment, the stitch size is used to determine the tightness or spacing between knitted chains. The tightness may be adjusted such that the tightness is consistent throughout the completed garment. In another embodiment, the tightness of the knit is adjusted such that the tightness varies through the garment. In one embodiment, the chain is made from a non-metallic material including plastic and metal coated plastic.

Figure 18A:
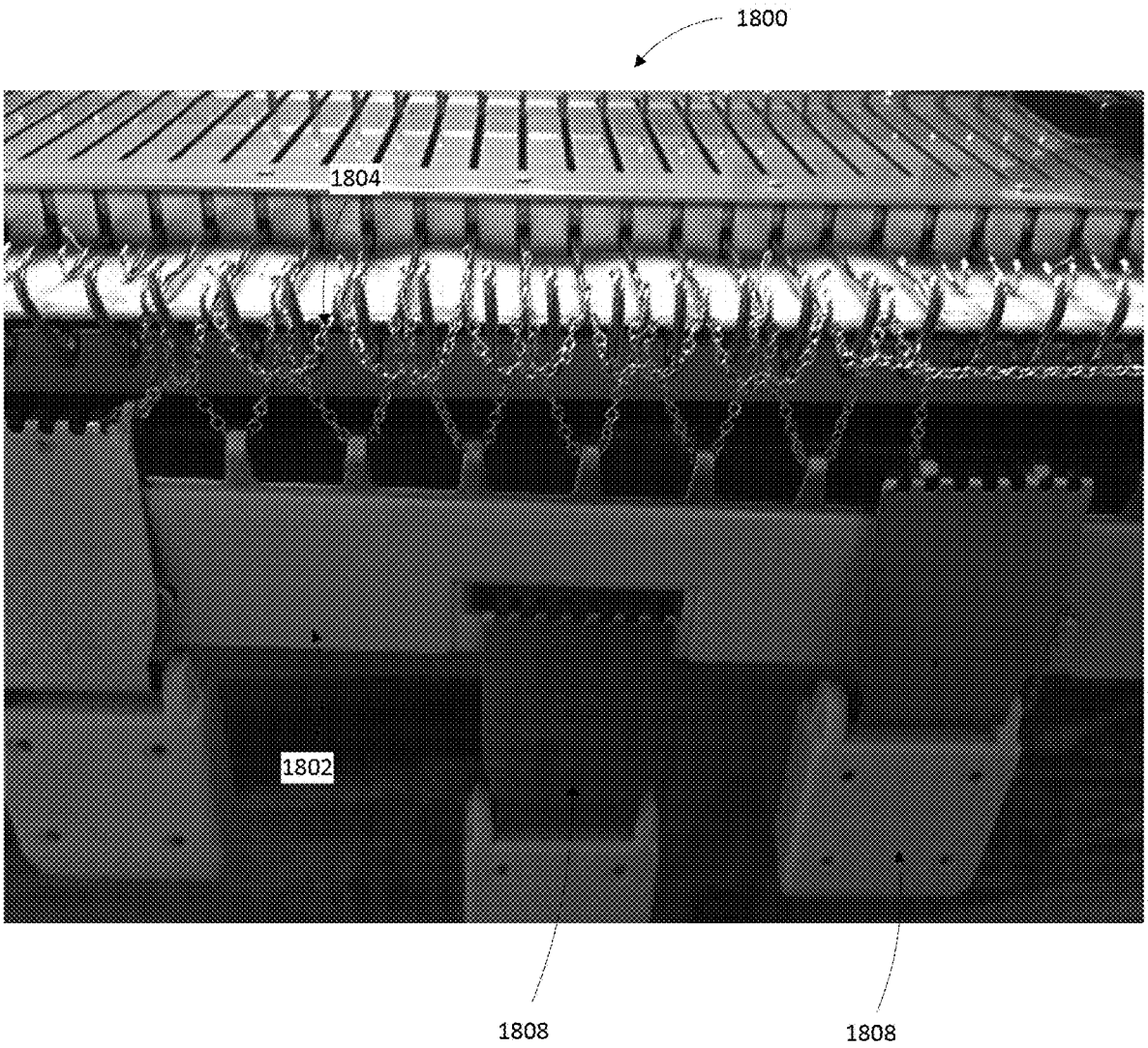
FIG. 18A is a partial view of an exemplary knitting machine.
Figure 19:
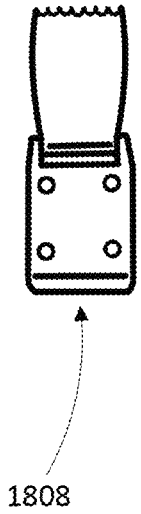
FIG. 19 is an illustration of claw weights used in an exemplary knitting machine.
Figure 20:
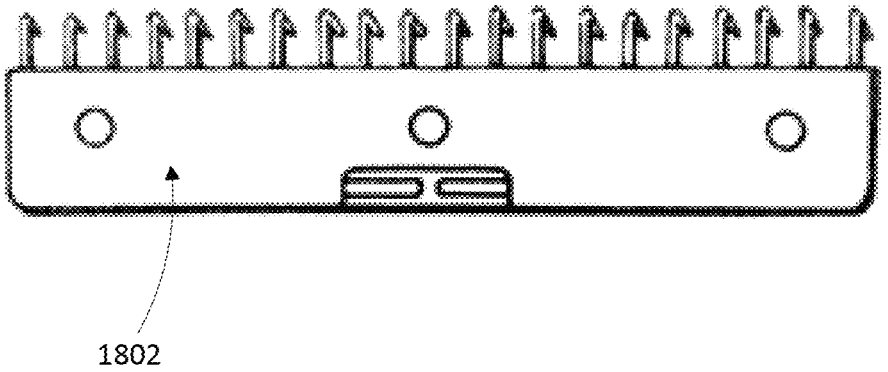
FIG. 20 is an illustration of comb weights used in an exemplary knitting machine.

As the fabric is knitted, it may no longer be necessary to weight the chain because as the chain is metal, the weight of the fabric increases as the size of the fabric increases and hence the fabric itself acts as the weight. Hence, the weight will be removed so as not to distort the fabric once the fabric becomes heavy enough to act as its own weight. During the process, the bottom of the fabric is weighted down by a comb weight and one or more claw weights. FIG. 18A is a partial view of a knitting machine 1800 with the comb weight 1802 engaging the lower edge of the metal chain fabric 1804. As shown, the comb weight engages the chain with engaging fingers 1808. One or more claw weights 1808 may also be used to add further weight to the fabric by engaging the comb weight. As the fabric becomes longer and hence weightier, the claw weights 1808 can be disengaged from the comb weight as can the comb weight eventually. However, the claw weights 1808 may be used to weigh down the end edges of the fabric directly after the comb weight has been disengaged to continue to maintain the tension and keep the chain from slipping off the end needles. The weights are used to make the metal fabric hang properly and prevent it from lifting up until the weight of the fabric itself no longer makes it necessary. The lighter the fabric, the longer the weights may have to be utilized in the process to ensure the fabric hangs properly. FIGS. 19 and 20 are illustrations of claw weights and comb weights.

A most preferred method of machine knitting the metal chain material includes providing at least one metal chain of links flexibly linked together, selecting a stitch size on a knitting machine, feeding the metal chain into the knitting machine, maintaining an even tension on the chain, weighting the lower edge of the knitted fabric, and knitting the metal chain into a knitted pattern to form a fabric.

Figure 18B:
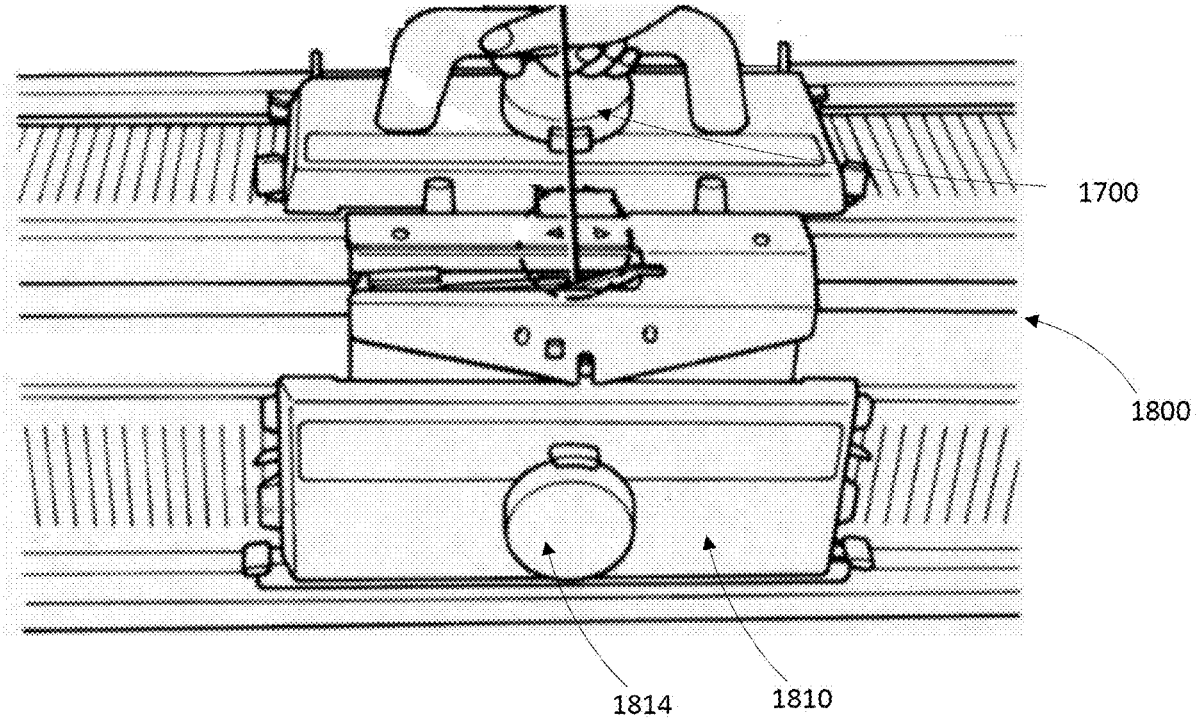
FIG. 18B depicts a knitting machine that includes a ribber attachment.
Figure 18C:
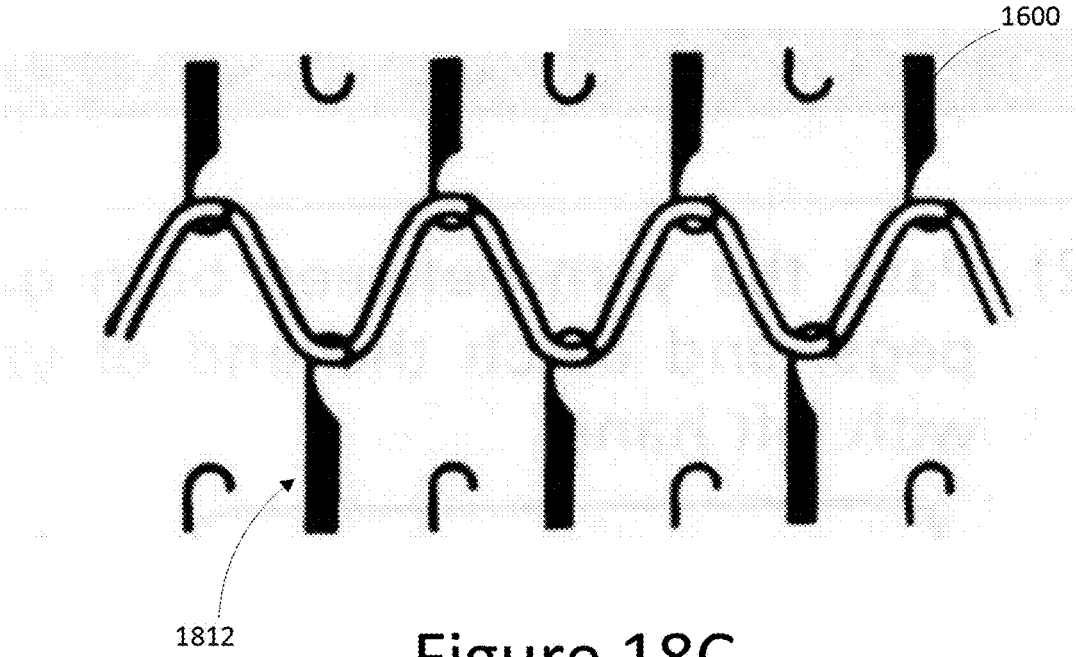
FIG. 18C depicts the needle arrangement of the ribber attachment and knitting machine.

FIG. 18B depicts a knitting machine 1800 that includes a ribber attachment 1810. The ribber attachment 1810 includes a plurality of needles 1812 and a separate carriage handle 1814 that is configured to control the tightness of the ribber knits. In one embodiment, the carriage handle 1700 is adjusted to the same setting as the carriage handle 1814. In another embodiment, the carriage handle 1700 is set to a different setting than the carriage handle 1814. Using a ribber attachment 1810, can allow for circular knitting, various forms of ribbed knitting, and additional patterns chain knitting. The ribber attachment 1810 attaches to the bottom of the standard knitting machine 1800. Although similar to knitting with yarn, greater care has to be taken when knitting with chain—such as knitting on every other needle, in order to not create too much tension (and therefor snap the chain). FIG. 18C depicts one example of a needle arrangement of the ribber attachment 1810 and knitting machine 1800. In this example, knitting machine needles 1600 engage a chain 1606 in an alternating pattern with the ribber needles 1812. The Ribber may be shifted to the right or left to create different needle arrangements as in traditional knitting with a ribber attachment.

Knit chain metal lace may also be made with the lace carriage (a separate carriage that comes with some machines) or by hand manipulation of stitches (like hand manipulated yarn lace). Further, knitting of images using metal chain can be made through fair isle techniques and other image knitting techniques. These images may be knit of "yarns" made of chain in combination with conventional yarns. Or the image may be knit of just metal chain in multiple colors of chain to create a pattern effect (such as that which is traditionally associated with holiday sweaters). Lastly, an image may also be produced by knitting the chain using the "lace knitting technique" which leaves holes in the knitting that create an image (like a lace pattern on conventional fabric).

Although the process of knitting the metal chain fabric is disclosed as utilizing conventional knitting machines, other machines may become available to knit the metal chains into a knitted fabric.

Throughout this specification, unless the context requires otherwise, the words "comprise" and "include" and variations such as "comprising" and "including" will be understood to imply the inclusion of an item or group of items, but not the exclusion of any other item or group items. While various examples of the invention have been described, it will be apparent to those of ordinary skill in the art that many more examples and implementations are possible within the scope of the invention. For example, while this description has focused on knitted fabrics made using metal links or chain as a "yarn" to create a stretchy and durable knit metal material.

Furthermore, industrial knitting machines as well as home or hobby knitting machines may be used to knit the fabric. While exemplary applications described herein include fashion and textile industries, other applications include, but are not limited to, bullet-proof vests and other military apparel/textiles, medical apparel (such as x-ray vests), and other applications where a metal with true four-way stretch could greatly enhance user experience, safety and comfort. Although various indications have been given as to the scope of this invention, the invention is not limited to any one of these but may reside in two or more of these combined together. Accordingly, the invention is not to be restricted except in light of the attached claims and their equivalents.

While various examples of the invention have been described, it will be apparent to those of ordinary skill in the art that many more examples and implementations are possible within the scope of the invention. Furthermore, although various indications have been given as to the scope of this invention, the invention is not limited to any one of these but may reside in two or more of these combined together.

The invention claimed is:

1. A knitted metal fabric comprising:

a single continuous metal chain including a plurality of links each having a hole with each link being axially connected to adjacent links at an intersection of two adjacent links to form a single co-axial row of connected links to form the chain, wherein the single continuous metal chain is intertwined with itself in a plurality of loops without creating any new links or connecting any additional links to the links in the chain to form a flexible and stretchable knit textile, wherein chain loops comprised of individually co-axially connected links are intertwined at the intersection of an adjacent loop such that the flexible and stretchable knit textile moves and stretches in multiple directions to conform to a shape of an object while in contact with an object and returning to an original shape when not in contact with an object.

2. The knitted metal fabric of claim 1, wherein the metal of the chain is non-magnetic.

3. The knitted metal of claim 2, wherein the metal of the chain is a noble metal.

4. The knitted metal of claim 2, wherein the metal of the chain is selected from the group consisting of gold, silver, platinum, copper, brass, palladium, rhodium, titanium, tungsten, tungsten carbide, nickel and stainless steel.

5. The knitted metal of claim 2, wherein the metal of the chain is an alloy of two or more metals.

6. The knitted metal of claim 1, wherein the at least two rows of metal chain are knitted or sewn to a non-metal fabric.

7. The knitted metal fabric of claim 1, wherein the metal chain comprises two different types of chains.

8. The knitted metal fabric of claim 1, wherein the links of the metal chain have holes ranging in size from about 0.5 mm×0.5 mm to about 4.0 mm×4.0 mm.

9. The knitted metal fabric of claim 8, wherein the holes are 3.0×3.0 mm or less in size.

10. The knitted metal fabric of claim 1, wherein the links have a length and width and the length is greater than the width.

11. The knitted metal fabric of claim 1, wherein the links have a length and width and the length is equal to the width.

12. The knitted metal fabric of claim 1, wherein the links have a length of 11 mm or less.

13. The knitted metal fabric of claim 1, wherein the links have a width of 11 mm or less.

* * * * *